US005401202A

United States Patent [19]

Guza et al.

[11] Patent Number: 5,401,202

[45] Date of Patent: Mar. 28, 1995

[54] PLAYTOWN CENTER

[76] Inventors: Anne M. Guza; Monica S. Guza, both of 2872 Delcourt Dr., Decatur, Ga. 30033

[21] Appl. No.: 795,993

[22] Filed: Nov. 22, 1991

[51] Int. Cl.[6] ..... A63H 33/42

[52] U.S. Cl. ..... 446/476; 446/478

[58] Field of Search ..... 446/476, 477, 478; 434/72, 79, 80, 107, 128, 219, 377, 386, 393, 432

[56] References Cited

U.S. PATENT DOCUMENTS

| | | | |
|---|---|---|---|
| 513,688 | 1/1894 | Smith | 446/478 |
| 1,505,034 | 8/1924 | Kussner | 446/478 X |
| 1,609,899 | 12/1926 | Bigelow | 446/478 |
| 2,259,783 | 10/1941 | Sparling | 446/478 X |
| 3,789,522 | 2/1974 | Moore | 446/478 X |
| 4,919,982 | 4/1990 | Hayes | 446/478 X |
| 5,005,083 | 10/1991 | Walker et al. | 446/476 X |

*Primary Examiner*—Robert A. Hafer
*Assistant Examiner*—Sam Rimell

[57] ABSTRACT

The PLAYTOWN CENTER is a design consisting of three upright panels which create three spaces for play. Each space provides a shelf to put things on or to work on, a window to look through or to use as a slot, and ample wall space. The structure includes accessories to help bring to life an ideal playing atmosphere for one or many more children.

1 Claim, 1 Drawing Sheet

PLAYTOWN CENTER

BACKGROUND OF THE INVENTION

1. Field of the Invention

This invention relates to a structure for children which promotes creative playing and learning.

2. Prior Art

There is a need for a children's play structure which allows greater freedom of movement and expression. Existing structures we have reviewed provide a playing space, however, a very limited one. The "Play House" (D302836), is too confining for children. Rarely can one observe children playing inside a play house for more than five or ten minutes. An enclosed space is too restricting for a child. The "Toy Play Scene" (D293699), limits a child by merely providing one kitchen game to play.

SUMMARY OF THE INVENTION

The openness of the structure is more appealing to a child than an enclosed structure. Our design encourages children to create and invent their own ideas. Instead of merely playing a "kitchen" or "house" type of game over and over again, children can choose from a variety of game activities. There are also individual game boxes which include all of the objects necessary to play. For example, the children can choose an adult-career to imitate and use the provided "tools" to act it out. With this, the structure becomes a Post Office, Boutique, Barber/Beauty Shop, Puppet Theatre, or Business Office.

Unlike the "Play House" and the "Toy Play Scene" designs, the design provides the space needed for one child or a group of children to be occupied at the same time. Three large panels, with one open space in each panel, stand upright with a 120° angle in between panels. This creates three separate yet united spaces for play and work. At the center of our design stands a supportive pole which resembles a street lamp post.

BRIEF DESCRIPTION OF THE DRAWINGS

Our play structure design is illustrated in the accompanying drawings.

DETAILED DESCRIPTION

Figure 1:
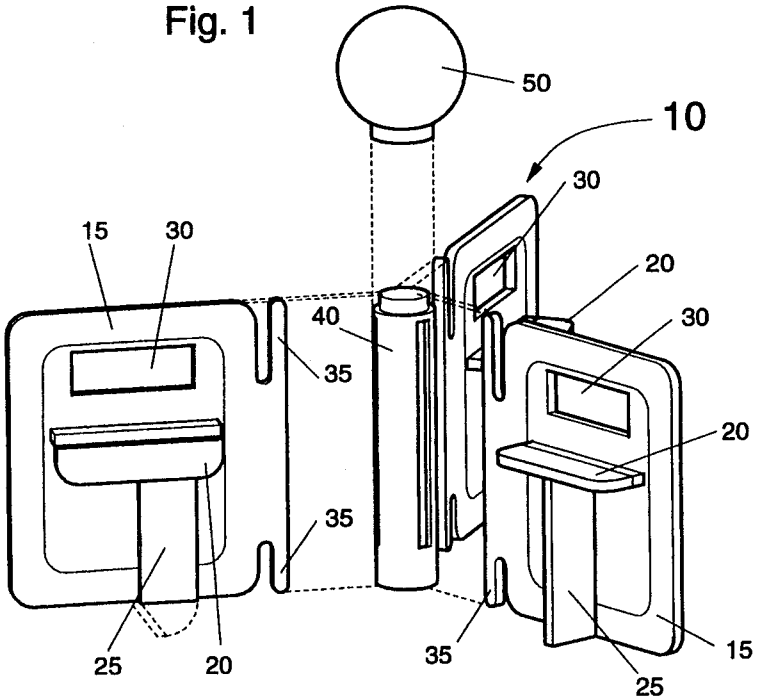
FIG. 1 is a perspective view showing the Playtown Center.
Figure 2:
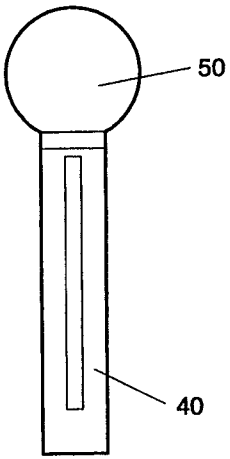
FIG. 2 is a view of the Center Pole.
Figure 5:
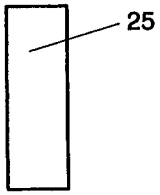
FIG. 5 is a support.
Figure 3:
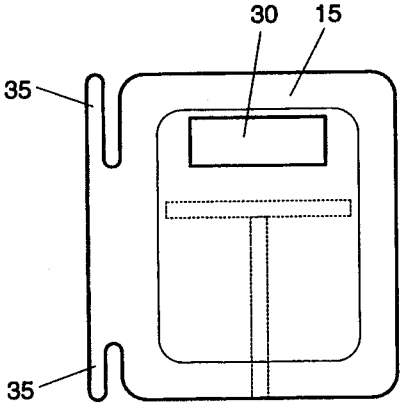
FIG. 3 is a support panel.
Figure 4:
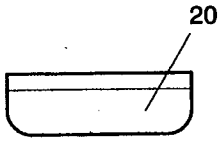
FIG. 4 is a shelf.

The structure (10), made of hard molded plastic material, consists of three two inch thick panels (15). Each panel measures thirty-six inches by forty inches and has a six inch by sixteen inch open space (30) centered six inches below the top of the panel. On one side of each panel and six inches below the bottom of the window is a seven inch by twenty-two inch shelf (20) which can be lowered or raised up by a hinge. Directly below the shelf stands a seven inch by twenty-two inch support (25) which is vertically hinged on to the panel. When the support is pulled out and the shelf raised up, one has a supported shelf for use.

The three panels form three cubicle-like spaces, each with a 120° angle. The intersecting points of the panels are held together by bracing hooks (35) (each panel has two bracing hooks), which are designed to fit inside a center pole (40). The pole is designed (refer to FIG. 6) to have three two inch by twenty-nine inch openings. The top of each opening begins five inches below the top of the pole and ends six inches above the base of the pole. These openings provide the space for the bracing hooks to fit. The eight inch diameter pole, which is forty inches in length, is covered at the top by a ball-shaped structure (50). This structure has a two inch neck which secures the intersecting top points of the panels.

Game boxes can be used with our "PLAYTOWN CENTER". Each box consists of accessories needed for playing particular games. The accessories are close to life size enabling a child to actually use them, and made of quality materials to provide extended use.

What we claim is:

1. A simulated town center for children's play comprising:

an elongated cylindrical pole;

first, second and third panels, each of said panels including an aperture therethrough and each of said panels including a shelf extending outwardly below said aperture, each of said panels further including attachment for attachment to said pole with said first, second and third panels being located at 120 degree intervals around said pole;

first second and third game kits for use with said first second and third panels, said first game kit including simulated grooming means, said second game kit including simulated jewelry and said third game kit including a simulated telephone and calculator;

each of said game kits further including a sign for use with said game kits for indicating a type of business that said game kit resembles.

* * * * *